US007096835B2

(12) United States Patent
Fujita et al.

(10) Patent No.: US 7,096,835 B2
(45) Date of Patent: Aug. 29, 2006

(54) VALVE TRAIN DEVICE FOR AN ENGINE

(75) Inventors: Hideo Fujita, Shizuoka-ken (JP); Koichi Hatamura, Hiroshima (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/990,557

(22) Filed: Nov. 17, 2004

(65) Prior Publication Data

US 2005/0126526 A1 Jun. 16, 2005

Related U.S. Application Data

(63) Continuation of application No. PCT/JP03/06202, filed on May 19, 2003.

(30) Foreign Application Priority Data

May 17, 2002 (JP) ..... 2002-143037

(51) Int. Cl.
*F01L 1/34* (2006.01)

(52) U.S. Cl. ..... 123/90.16; 123/90.15; 123/90.39

(58) Field of Classification Search ..... 123/90.15, 123/90.16, 90.31, 90.39
See application file for complete search history.

(56) References Cited

U.S. PATENT DOCUMENTS 4,572,118 A 2/1986 Baguena
4,714,057 A 12/1987 Wichart
5,018,487 A * 5/1991 Shinkai ..... 123/90.16
5,189,998 A 3/1993 Hara
5,373,818 A 12/1994 Unger
6,425,357 B1 * 7/2002 Shimizu et al. ..... 123/90.16
2001/0052329 A1 12/2001 Himsel

FOREIGN PATENT DOCUMENTS

JP 6-93816 A 4/1994
JP 6-307219 A 11/1994
JP 11-36833 2/1999
JP 2003-106123 4/2003
JP 2003-239713 A 8/2003

OTHER PUBLICATIONS

International Search Report for Application No. PCT/JP2004/006428 (the PCT counterpart of the parent application).

* cited by examiner

*Primary Examiner*—Thomas Denion
*Assistant Examiner*—Zelalem Eshete
(74) *Attorney, Agent, or Firm*—Knobbe, Martens, Olson & Bear, LLP.

(57) ABSTRACT

A valve train device is provided for swinging a rocker arm, which is pivotally disposed on a rocker arm support shaft. The device comprises a drive device for driving the rocker arm, an intermediate member disposed between the drive device and the rocker arm and configured to transfer movement of the drive device to the rocker arm, and a displacement device. The displacement device is configured to displace a contact point between the rocker arm and the intermediate member to continuously adjust at least one of the valve opening duration and valve lift.

20 Claims, 14 Drawing Sheets

VALVE TRAIN DEVICE FOR AN ENGINE

PRIORITY INFORMATION

The present application is a continuation of PCT Application No. PCT/JP03/06202, filed on May 19, 2003, which claims priority under 35 U.S.C. § 119 to Japanese Patent Application No. 2002-143037, filed on May 17, 2002, and the entire contents of both of which are expressly incorporated by reference herein.

BACKGROUND OF THE INVENTION

1. Field of the Invention

This invention relates to an engine valve train device for continuously controlling an opening duration or a lift of a valve.

2. Description of the Related Art

Conventionally, engine valve train devices for continuously controlling an opening duration and a lift of a valve have been in practical use. For example, there has been proposed such a valve train device in JP-A-Sho59-500002, in which, to open and close intake and exhaust valves by cam shafts via rocker arms, a swinging member for each valve is disposed and swung by the camshaft, an intermediate roller is interposed between a swing cam face of the swinging member and the rocker arm, and the valve opening duration and the valve lift can be continuously changed by displacing the intermediate roller.

Now, in such conventional valve train devices, the shorter the valve opening duration, the smaller the lever ratio of the rocker arm, and, in contrary, the longer the valve opening duration, the larger the lever ratio of the rocker arm. Due to the larger lever-ratio for a longer valve opening duration, a distal end of the rocker arm presses against the valve, and the intermediate roller presses against the intermediate portion of the rocker arm. As a result, it is difficult to secure rigidity of the entire valve opening/closing device. In particular, accuracy of control over the valve opening duration and the valve lift is apt to reduce during operation at high engine speeds. Further, due to a smaller lever-ratio for a shorter valve opening duration, it is difficult to secure the valve lift for a shorter valve opening duration, which is disadvantageous for reduction of pumping loss and improvement of combustibility. Thus, controllability of valve opening and closing timing is also apt to worsen.

SUMMARY OF THE INVENTION

Therefore, an object of the invention is to provide a valve train device that is rigid, provides accurate control of the valve lift for shorter valve opening duration, and provides the ability to continuously control the valve opening and closing timing.

Accordingly, one embodiment of the present invention comprises a valve train device of an engine for swinging a rocker arm, which is pivotally disposed on a rocker arm support shaft. The valve opens and closes a valve opening in a combustion chamber. The device comprises a drive device for driving the rocker arm, an intermediate member disposed between the drive device and the rocker arm and configured to transfer movement of the drive device to the rocker arm, and a displacement device. The displacement device includes a moveable portion that is coupled to an arm. A portion of the arm movies about a first axis. The displacement device is configured such that at least one of the valve opening duration and valve lift is increased as the moveable portion is displaced farther from the first axis.

Accordingly, another embodiment of the present invention comprises a valve train device of an engine for swinging a rocker arm, which is pivotally disposed on a rocker arm support shaft. The valve opens and closes a valve opening in a combustion chamber. The device comprises a drive device for driving the rocker arm and an intermediate member disposed between the drive device and the rocker arm and configured to transfer movement of the drive device to the rocker arm. The device also includes displacement means for displacing a contact point between the rocker arm and the intermediate member to continuously adjust at least one of the valve opening duration and valve lift where at least one of the valve opening duration or valve lift is increased as the contact point is displaced further from the rocker arm support shaft.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

A general architecture that implements various features of specific embodiments of the invention will now be described with reference to the drawing. The drawing and the associated descriptions are provided to illustrate embodiments of the invention and not to limit the scope of the invention.

FIG. 10 is a cross-sectional side view of a fourth embodiment of the.

DETAILED DESCRIPTION OF THE PREFERRED EMBODIMENT

Several embodiments of the invention are described with reference to the accompanying drawings.

Figure 1:
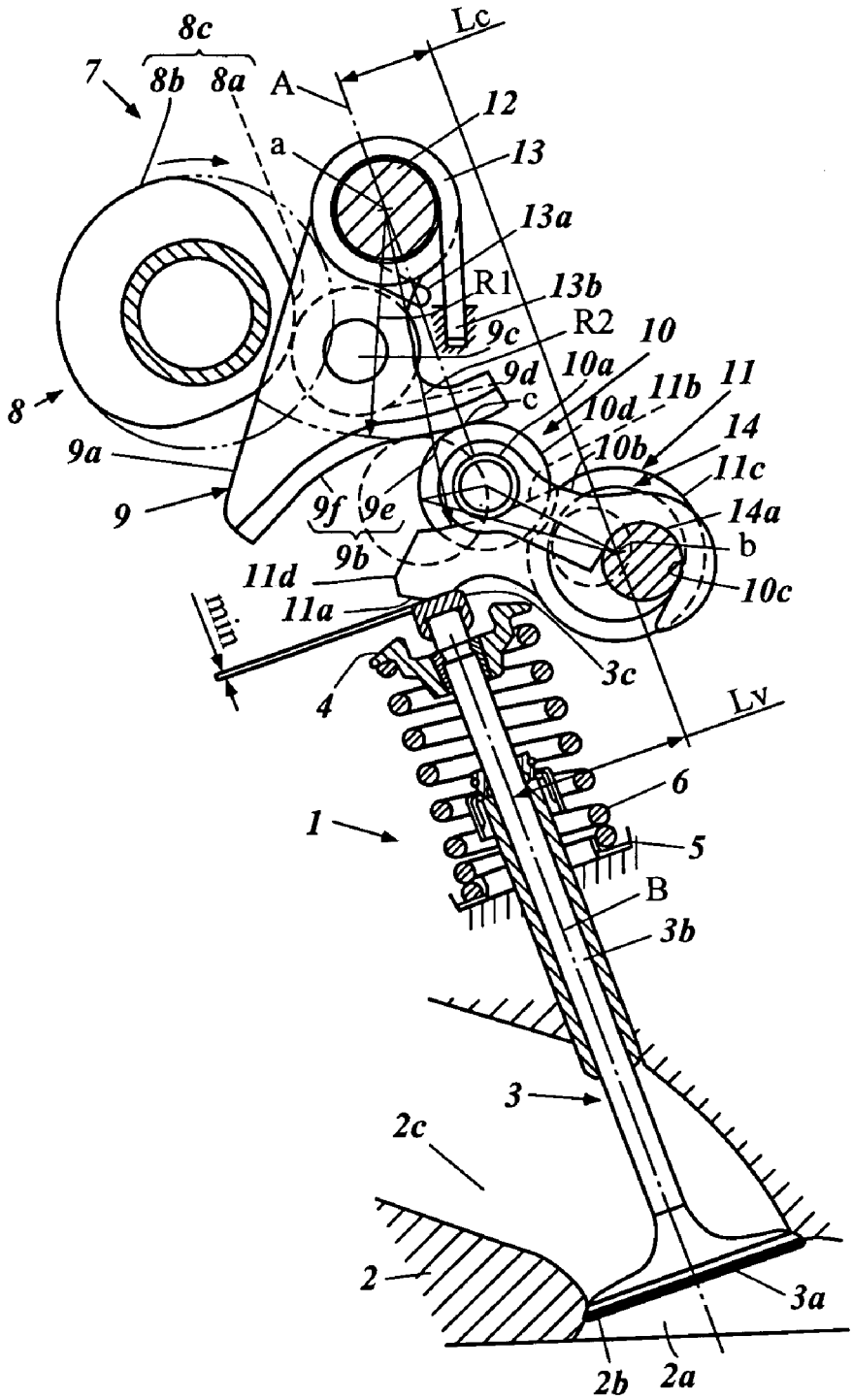
FIG. 1 is a cross-sectional side view, showing a first embodiment of a valve train device in a first position.
Figure 2:
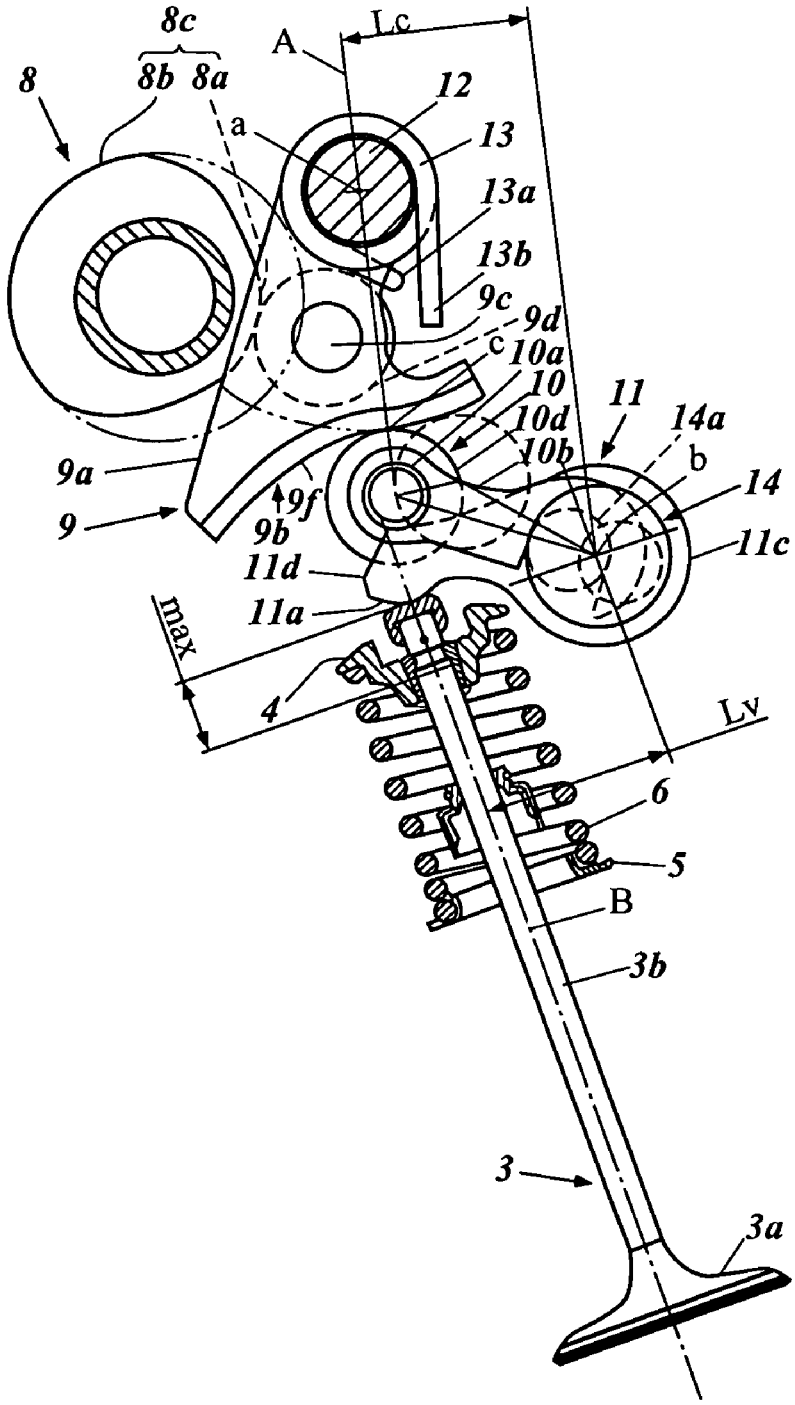
FIG. 2 is a cross-sectional side view of the first embodiment of the device in a second position.
Figure 3:
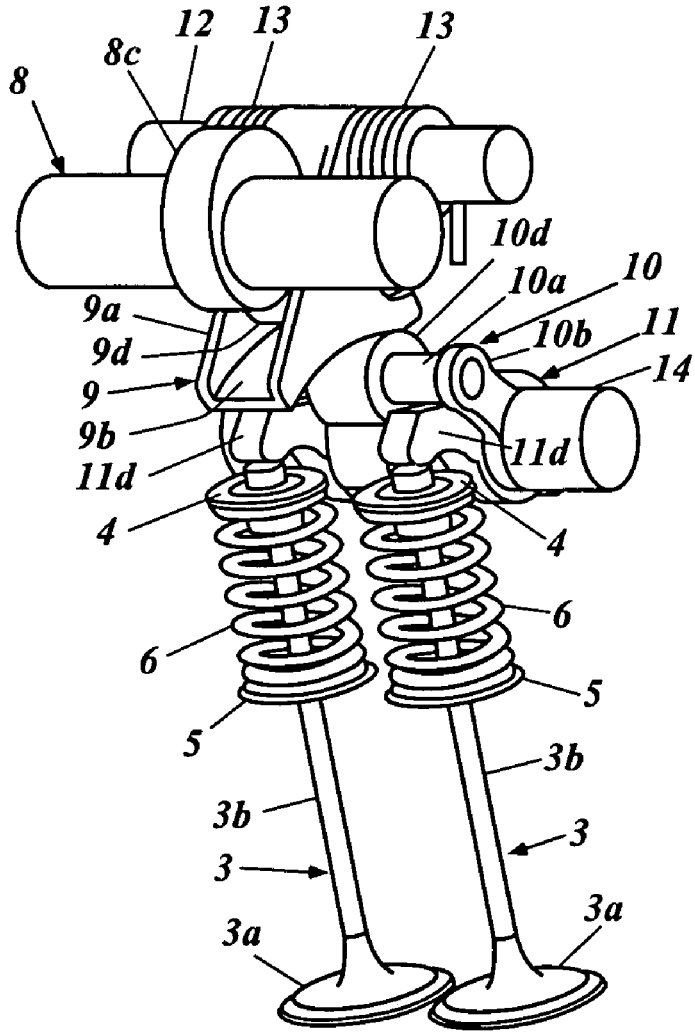
FIG. 3 is a front, perspective view of the first embodiment of the device.
Figure 4:
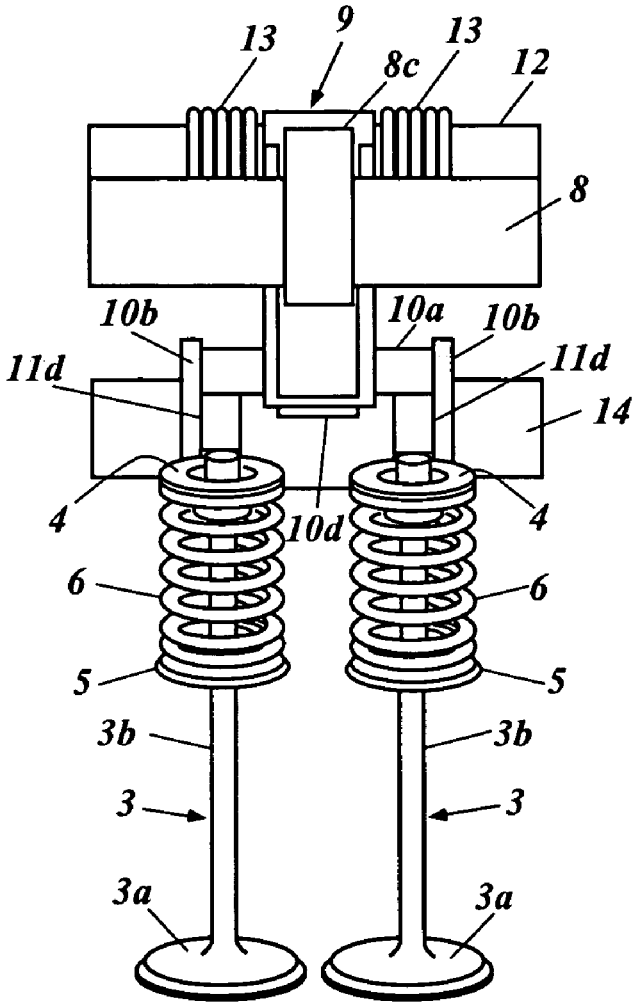
FIG. 4 is a front view of the first embodiment of the device.
Figure 5:
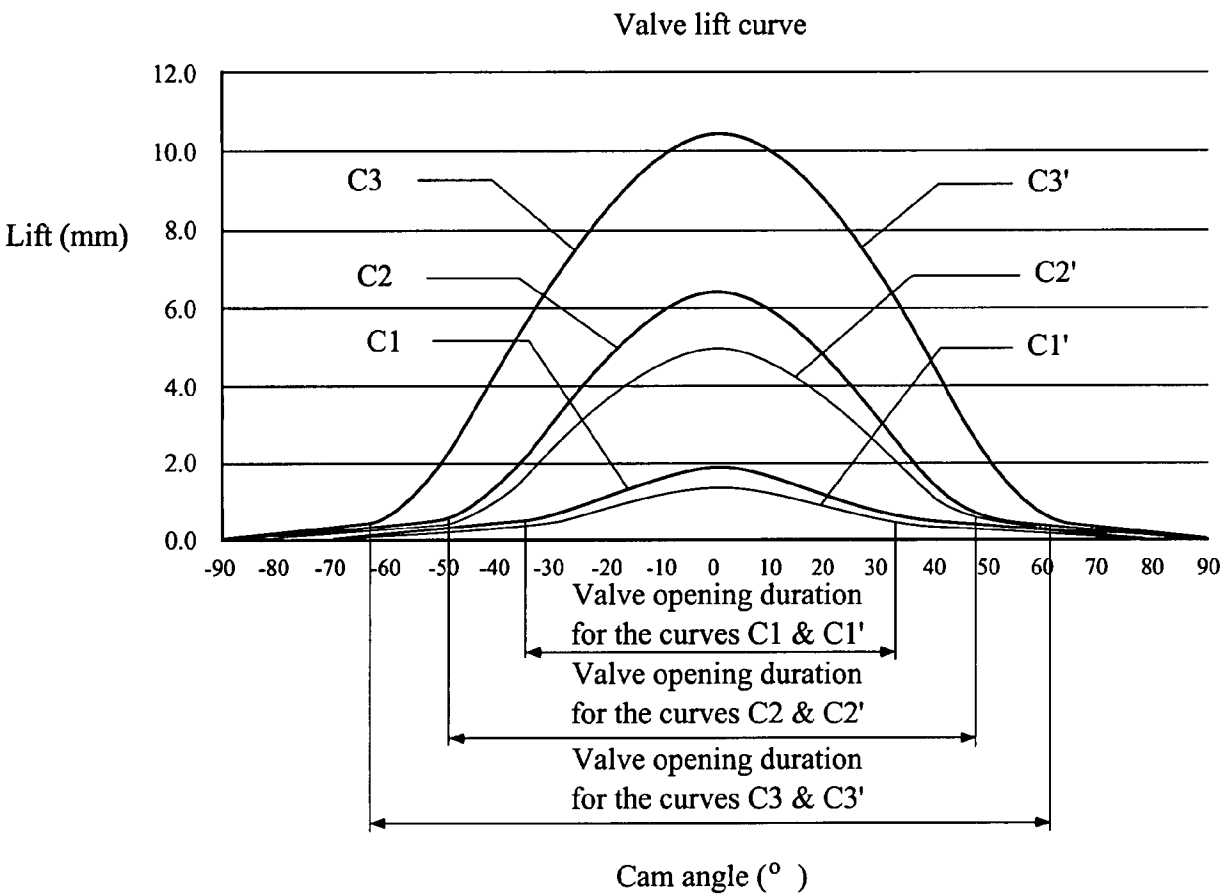
FIG. 5 shows a graph of a cam angle-lift characteristic curve of the first embodiment of the device.

FIGS. 1 through 5 describe a first embodiment. FIG. 1 and FIG. 2 are cross-sectional side views, showing a smaller opening state and a larger opening state on an intake valve side, respectively, of a valve train device of an engine. FIG. 3 and FIG. 4 are a front perspective view and a side view of the first embodiment, respectively. FIG. 5 shows a cam angle—lift characteristic curve of the first embodiment.

In the embodiments described below, reference will be made to the intake valve. However, it should be appreciated that certain features and aspects of these embodiments may also be applied to an exhaust valve. It should also be appreciated that various features, aspects and advantages of the present invent may be used with engines having more than one intake valve and/or exhaust valve, and any of a variety of configurations including a variety of numbers of cylinders and cylinder arrangements (V, W, opposing, etc.

Referring to FIG. 1, reference numeral 1 denotes a valve device for opening and closing valve openings that open into a combustion chamber. The valve device is constituted as follows. A right and a left intake opening 2*b* are formed in a combustion recess 2*a* that is formed in a cylinder head 2 and that forms part of a combustion chamber on a ceiling side thereof. Each intake valve opening 2*b* is in fluid communication with an intake port 2*c*, which in turn leads to an external connection port in an engine wall. Also, each intake valve opening 2*b* is opened and closed by a valve head 3*a* of an intake valve 3. The intake valve 3 is normally biased by a valve spring 6 that is interposed between a retainer 4, which is mounted at the top end of a valve stem 3*b* of the intake valve 3 and is prevented from moving axially, and a spring seat 5 that is placed on a seat surface of the cylinder head 2.

A valve train device 7 is disposed over the intake valves 3 and is constituted such that an intake camshaft 8, which functions as a swinging member driving device to swings each swinging member 9. The swinging member 9 swings a rocker arm 11 through an intermediate rocker 10, and the swinging movement of the rocker arm 11 forces the intake valve 3 to travel to and fro in its axial direction, thereby opening and closing the valve opening 2*b*.

The intake camshaft 8 is arranged parallel to a crankshaft (not shown), supported for rotation and prevented from moving in both of its axial direction and a direction normal to the axial direction, by cam journals formed in the cylinder head 2 and corresponding cam caps mounted on an upper mating surface of the cam journals. The intake camshaft 8 is formed with one cam nose 8*c* which is in common with the right and left intake valves and consists of a base circle section 8*a* having a constant outside diameter and a lift section 8*b* having a predetermined cam profile.

The swinging member 9 includes a pair of swing arm portions 9*a*, 9*a*, a swing cam face 9*b*, a roller shaft 9*c*, and swing roller 9*d*. The pair of swing arm portions 9*a*, 9*a* is supported for free rotation by a swing shaft 12 that is arranged parallel to the intake camshaft 8 and is prevented from moving in its axial direction and a direction normal thereto. The swing cam face 9*b* is formed so as to connect both the distal ends (lower ends) of the paired swing arm portions 9*a*, 9*a*. The roller shaft 9*c* is disposed midway of the swing arm portions 9*a* and parallel to the swing shaft 12 so as to pass through the right and left swing arm portions 9*a*, 9*a*. The swing roller 9*d* is supported for rotation by the roller shaft 9*c*, the swing roller 9*d* normally being in contact with the cam nose 8*c* for rotation.

The swing shaft 12 passes through the bases (upper end portion) of the swing arm portions 9*a* and swings. A pair of right and left balancing springs 13 of coil springs are mounted to the swing shaft 12. Each balancing spring 13 has a first end 13*a* that engages an edge positioned on the opposite side of the camshaft and between the roller shaft 9*c* and the swing shaft 12 of the swing arm portions 9*a*, and has a second end that engages the cylinder head 2. The paired balancing springs 13 bias the swinging member 9 so that the swing roller 9*d* contacts the cam nose 8*c* of the intake camshaft 8, to thereby avoid the weight of the swinging member 9 from acting on the valve spring 6.

The swing cam face 9*b* is generally shaped as a plate, having a curved surface in a base circle section 9*e* and a lift section 9*f* which are connected to each other continuously. The swinging member 9 is arranged in a way that the base circle section 9*e* is located on a rocker shaft side 14 and the lift section 9*f* is located on the opposite side thereof. The base circle section 9*e* is an arc having a radius R1 and a swinging axis (a) which is an axis of the swing shaft 12. Accordingly, while the base circle section 9*e* is in contact with the swing roller 9*d* and the swinging angle of the swinging member 9 increases, the intake valve 3 remains in its fully closed position and is not lifted.

On the other hand, as the point of the lift section 9*f* which presses against the swinging roller 9*d* progresses toward an apex of the lift section 9*f* and the swinging angle of the swinging member 9 becomes larger, the intake valve 3 is lifted more. The lift section 9*f* is constituted with a ramp zone for a constant velocity, an acceleration zone for acceleration of velocity, and a lift zone for an approximately constant velocity.

The rocker arm 11 is formed in one body such that it has a cylindrical base 11*c*, and right and left arm portions 11*d* extending forward (on the side of the intake valves). The base 11*c* is supported, for swing, by the rocker shaft 14 that is disposed parallel to the intake camshaft 8 and on the side of an axis of the cylinder. At the lower portion of the distal end of each arm portion 11*d* is formed a valve pressing face 11*a* so as to press against a shim 3*c* that is mounted to the upper end of a valve stem 3*b* of the intake valve 3. In an upper peripheral portion of each arm portion 1*d* is formed a pressurized rocker face 11*b*, which is pushed by a rocker pin 10*a* of the intermediate rocker 10. The pressurized rocker face 11*b* is formed into an arc having a radius R2 about the swinging axis (a) of the swinging member 9, as seen in the direction of the camshaft with the valve being fully closed.

The rocker shaft 14 is constituted so that the angular position of the rocker shaft 14 is freely controlled by a drive mechanism (not shown). Midway of the rocker shaft 14 is formed an eccentric pin portion 14*a* that has a diameter smaller than any other portions and deviated outwardly in a radial direction from the axis b of the rocker shaft 14. An engagement recess 10*c* formed in the base end of the intermediate arm portion 10*b* of the intermediate rocker 10 is rotationally engaged with the eccentric pin portion 14*a*.

The intermediate rocker 10 is generally configured such that both distal ends of the paired right and left intermediate arm portions 10*b* are fixedly connected to each other by the rocker pin 10*a* extending in the direction of the camshaft, and the rocker roller 10*d* is rotationally supported by the rocker pin 10*a*. The distal ends of the intermediate arm portions 10*b* may be coupled by engagement of the rocker pin 10*a*. The rocker roller 10*d* rotationally contacts the swing cam face 9*b* of the swinging member 9, and the rocker pin 10*a* slidably contacts the pressurized rocker face 11*b* of the rocker arm 11.

Thus, a displacing device is constituted such that the drive mechanism varies the angular position of the rocker shaft 14 to move or displace the positions of both the intermediate rocker roller 10*d* of the intermediate rocker 10 and the intermediate rocker pin 10*a* along the pressurized rocker face 11*b*.

A rocker lever ratio may be defined as Lv/Lc, where Lc is a distance between the swinging axis (b) of the rocker arm 11 and a straight line (A) which connects the swinging center (a) of the swinging member 9 and the point at which the swing cam face 9*b* contacts the intermediate rocker roller 10*d*; and Lv is a distance between the valve axis and the swinging center (b) of the rocker arm 11. The lever ratio increases as the opening duration of the valve becomes shorter.

The drive mechanism changes the angular position of the rocker shaft 14 to move or displace the positions of the intermediate rocker roller 10*d* and the intermediate rocker pin 10*a* of the intermediate rocker 10 along the swing cam face 96 and the pressurized rocker face 11*b*, causing the valve lift and the valve opening angle to change continuously. The drive mechanism controls the angular position of the rocker shaft 14 in such a manner that the valve opening angle and the valve lift increase as the valve opening increases in response to the opening of an acceleration pedal, for example.

Specifically, in FIG. 1, for example, in a small opening state in which the valve opening duration is shortest and the maximum valve lift is smallest, the rocker shaft 14 is rotated at a position where the eccentric pin portion 14*a* is farthest away from the swing cam face 9*b*. The contact point (c) between the swing cam face 9*b* and the rocker roller 10*d* is therefore positioned farthest away from the lift section 9*f*. Also, the rocker lever ratio (Lv/Lc) reaches its largest value because the contact point (c) is brought into a position closest to the swinging center (b) of the rocker arm 11, and the distance Lc is shortest. For this state, a lift curve is therefore drawn as a curve C1 shown in FIG. 5.

Figure 6:
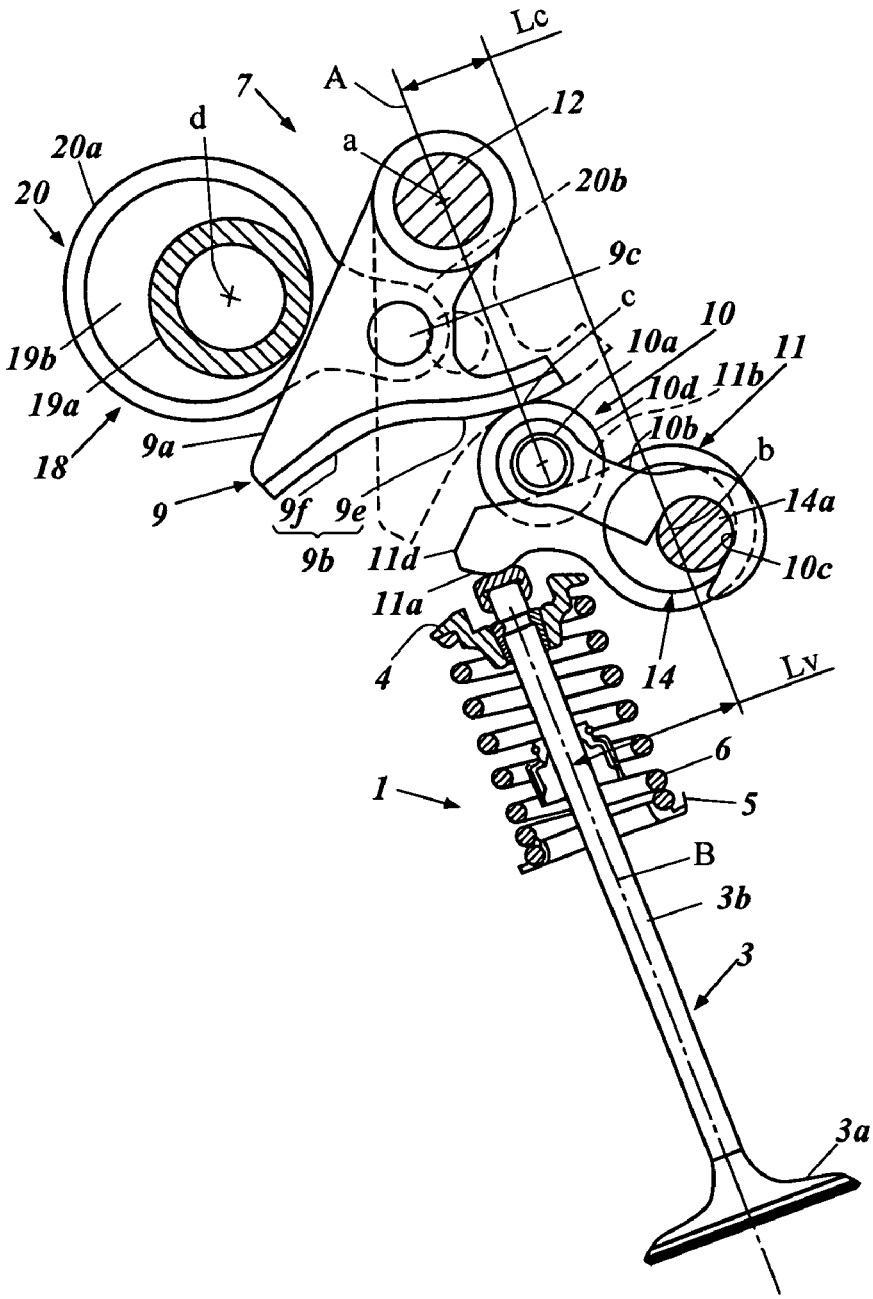
FIG. 6 is a cross-sectional side view of a second embodiment of the device in a first position.

Meanwhile, in FIG. 2, for a large opening state in which the valve opening duration is longest and the maximum valve lift is largest, the rocker shaft 14 is rotated at a position where the eccentric pin portion 14*a* is closest to the swing cam face 9*b*. The contact point (c') between the swing cam face 9*b* and the intermediate rocker roller 10*d* is therefore positioned nearest to the lift section 9*f*, and, more specifically, at a position close to a boundary between the lift section 9*f* and the base circle section 9*e*. Also, the rocker lever ratio (Lv/Lc) reaches its smallest value because the contact point (c') is remote from the swinging center (b) of the rocker arm 11 and the distance Lc is largest. For this state, a lift curve is therefore drawn as a curve C3 shown in FIG. 5. With a transition from the small opening state to the large opening state, the lift curve is, as shown in FIG. 6, continuously changed from the curve C1 to the curve C3.

In FIG. 5, lift curves C1' to C3' are comparative examples in case of a constant rocker lever ratio. This comparative device has the same large opening state as that of the present invention. The changes in the valve lift from the large opening state to the small opening state are comparatively shown. It is apparent from those curves that, in the comparative device, the lift curves show large drops of the valve lift from the curve C3' to C2' and to C1', and, in contrast, in this embodiment, the lift curves show that the lift drops are suppressed from the curve C3 to C2 and to C1. It is also clear that if the valve opening of the embodiment and the comparative device is the same, then the lift drop of the embodiment is smaller than that of the comparative devices.

In each lift curve of FIG. 5, outer portions outside of the valve opening duration represent a ramp zone in which the valve lift height corresponds to a valve clearance. Within this ramp zone, the valve is not opened due to the valve clearance in a cold state. However, the valve will be slightly opened nearly from the end of the ramp zone by thermal expansion of the valve stem in a hot operation of the engine.

In the embodiment, the swinging member 9 swings with the rotation of the camshaft 8, and the swinging of the swinging member 9 causes the swing cam face 9*b* to push against the intermediate rocker roller 10*d*, thereby oscillating the intermediate rocker member 10. Then, the intermediate rocker pin 10*a* of the intermediate rocker member 10 oscillates the rocker arm 11 to open and close the intake valve 3.

Subsequently, the rotation of the rocker shaft 14 continuously displaces the intermediate rocker roller 10*d* of the intermediate rocker member 10, the swing cam face 9*b* of the intermediate rocker pin 10*a*, and the contact point (c) with the pressurized rocker face 11*b*, which allows the valve opening duration and the valve lift to be controlled continuously.

Further, this embodiment is highly versatile, since there is no phase lag between the valve lift curves in the large and small opening durations. In other words, common mechanisms and components may be used for a right bank and a left bank of a V-engine.

Using the rotational motion of the rocker shaft 14 to move the intermediate rocker member 10, an extremely simple configuration can be obtained, resulting in an improvement of accuracy of control over the valve opening duration and the maximum valve lift.

For the purpose of displacing the contact point (c) using the rotational motion of the rocker shaft 14, a constitution is adopted that the base end of the intermediate rocker member 10 is swingably coupled with the eccentric pin portion 14*a* formed midway of the rocker shaft 14. The rotation of the rocker shaft 14 causes the intermediate rocker roller 10*d* and the intermediate rocker pin 10*a* to displace along the swing cam face 9*b* and the pressurized rocker face 11*b*. As a result, with an extremely simple constitution, the valve opening duration and the valve lift can be changed continuously.

A relative slide which occurs between the intermediate rocker pin 10*a* of the intermediate rocker member 10 and the pressurized rocker face 11*b* of the rocker arm 11 when the valve is opened and closed can be considerably reduced, since the rocker shaft 14 as the swinging axis of the rocker arm 11, and the eccentric pin portion 14*a* as the swinging axis of the intermediate rocker member 10 are positioned in proximity to each other.

Meanwhile, as shown in FIG. 2, for a large opening state in which the valve opening duration is long and the maximum valve lift is large, the intermediate rocker roller 10*d* and the intermediate rocker pin 10*a* of the intermediate rocker member 10 are displaced to the opposite sides of the rocker shaft. Accordingly, the rocker lever ratio (Lv/Lc) is small, to thereby push atop of the intake valve 3. Bending moment acting on the rocker arm 11 is therefore reduced, resulting in an increase of rigidity of the entire valve opening and closing mechanism.

On the other hand, in a small opening state in which both the valve opening duration and the maximum valve lift are small, as shown in FIG. 1, the intermediate rocker roller 10*d* and the intermediate rocker pin 10*a* are displaced to the rocker shaft 14 side. Accordingly, the rocker lever ratio (Lv/Lc) is large, and it is therefore easy to secure the maximum valve lift, in spite of a short opening duration of the valve (Refer to the curves C1 and C1', in FIG. 5). From this, it is possible to contemplate reduction of pumping loss, improvement of combustion, prevention of the ramp velocity in the valve lift curve from lowering, and ability to control timing of the valve opening and closing.

Further, the swing roller 9*d* is disposed within a space defined by lines connecting between the swinging center (a) of the swinging member 9 and both ends of the swing cam face 9*b*, as seen in the direction of the camshaft. As a result, bending moment generated due to a rotary force of the camshaft 8 at a portion for supporting the swing roller 9*d* can be caused to be smaller, compared with a conventional configuration in which a swing roller is supported at the distal end of a separate arm, for example, and the resultant rigidity of the swinging member is increased.

Furthermore, the balance springs 13 are provided for rotatably urging the swing member 9 in a direction that restricts the weight of the swing member 9 from working on the valve spring 6, which urges the valve in a closed state. Therefore, disposing the swing member 9 does not increase load on the valve spring 6. Thus, there is no need to increase the spring load of the valve spring 6, thereby providing optimum follow-up characteristics of the valve at high engine speed.

Figure 7:
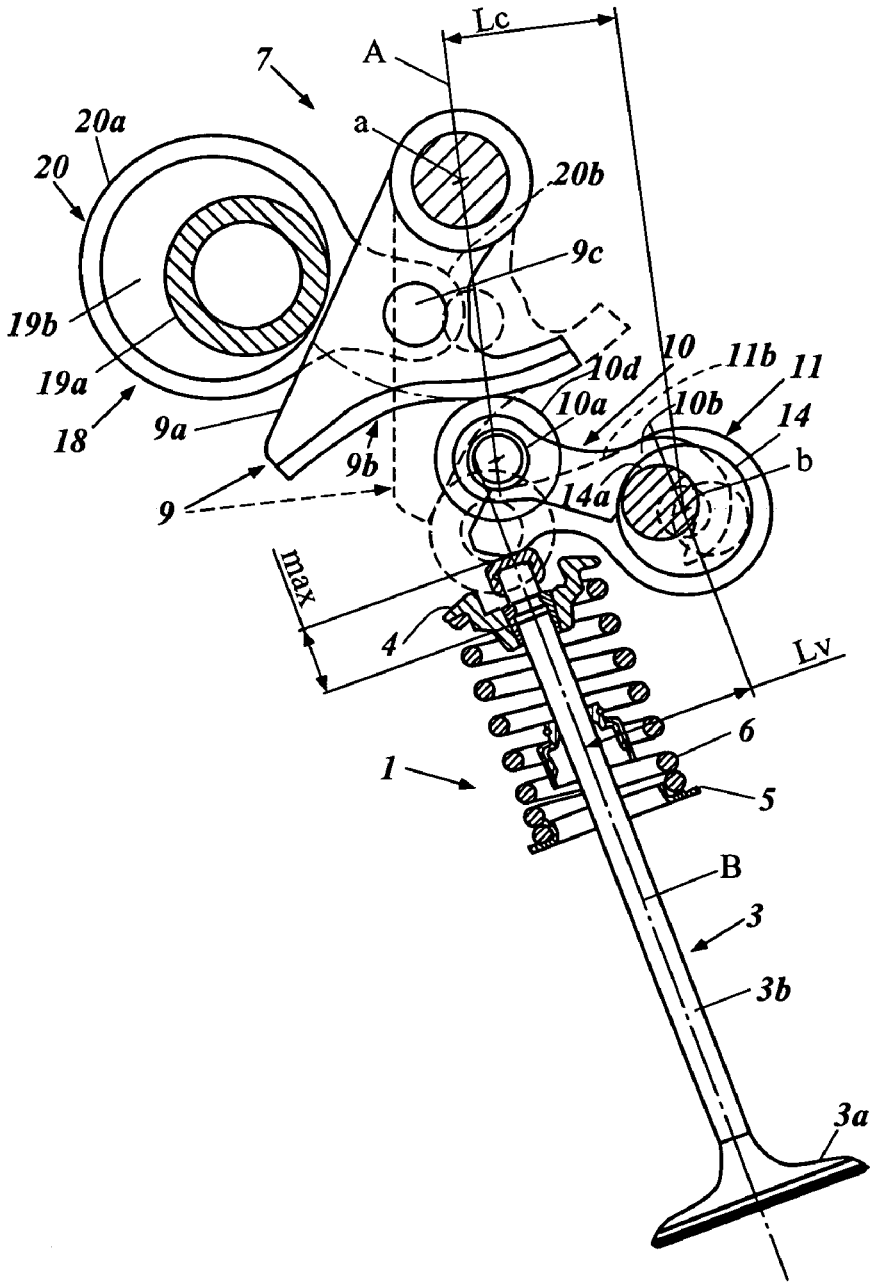
FIG. 7 is a cross-sectional side view of the second embodiment of the device in a second position.

FIGS. 6 and 7 are drawings for describing a second embodiment according to the invention, in which the same reference numerals and symbols as those in FIGS. 1 and 2 represent the same parts or the equivalents.

The second embodiment is an example in which the camshaft is of crankshaft type. That is, a crankshaft (camshaft) 18 includes a drive shaft 19*a* and a disk-like cam plate 19*b*, which is formed midway of the drive shaft 19*a* in one body and located eccentrically relative thereto. To the cam plate 19*b* is rotatably mounted a base 20*a* of a plate-like connecting rod 20, the distal end 20*b* of which is also rotatably coupled with a roller shaft 9*c* of the swinging member 9.

In the second embodiment, rotation of the drive shaft 19*a* eccentrically rotates the cam plate 19*b* about the axis (d). The connecting rod 20 oscillates the swinging member 9, and this swinging motion causes the rocker arm 11 to open and close the intake valve 3 through the intermediate rocker member 10.

In the second embodiment, since the camshaft is of a crankshaft type, it is possible to oscillate the swinging member 9 easily, securely with ability to follow exactly, the valve opening duration and the valve lift are controllable accurately, and any balancing spring is not needed.

Figure 8:
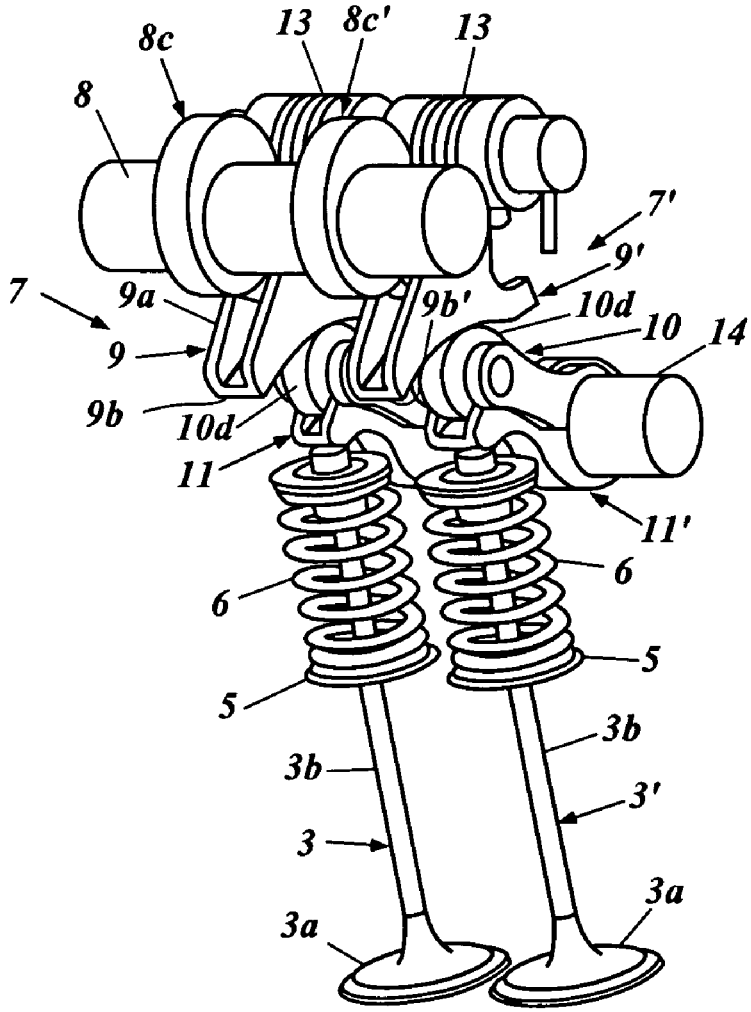
FIG. 8 is a perspective view of a third embodiment of the device.
Figure 9:
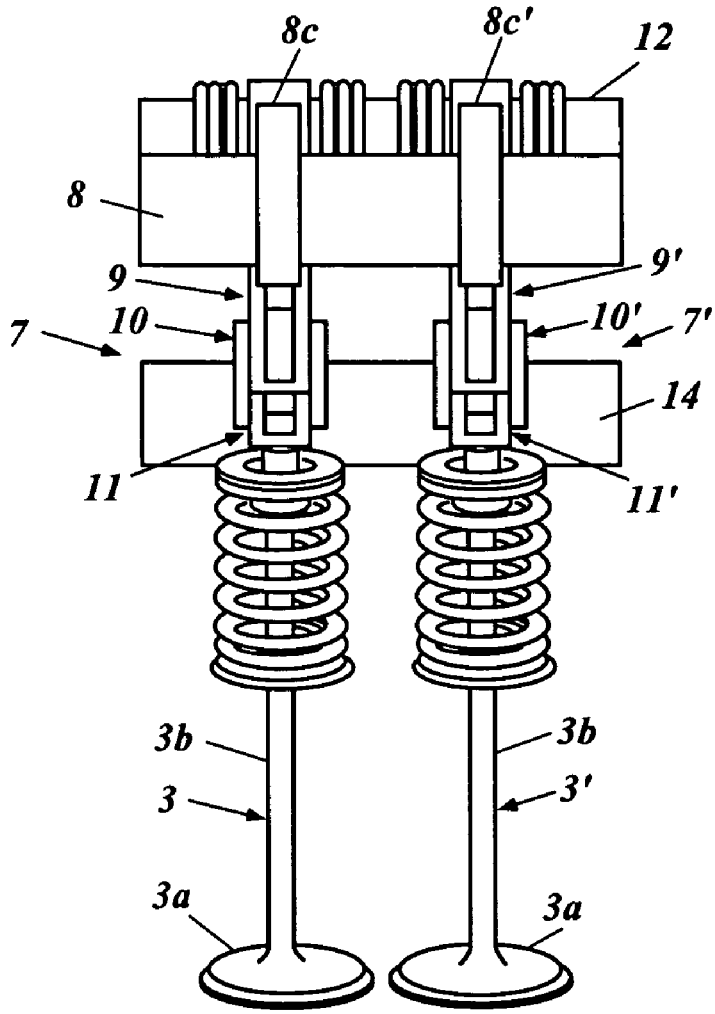
FIG. 9 is a front view of the third embodiment of the device.

FIGS. 8 and 9 are drawings for description of a third embodiment according to the invention, in which the same reference numerals and symbols as those in FIGS. 1 and 2 represent the same parts or the equivalents.

The third embodiment is an example in which separate valve train devices 7, 7 are provided for the right and left intake valves 3, 3', respectively. Specifically, it is constituted such that a left cam nose 8*c* and a right cam nose 8*c'* oscillate a left swinging member 9 and a right swinging member 9', respectively, which in turn oscillate a left rocker arm 11 and a right rocker arm 11', respectively, which subsequently advance and retract the intake valves 3, 3', respectively, to thereby open and close the intake valve openings 2*b*, 2*b'*.

In the third embodiment, since the left and right valve train devices 7, 7' are separately disposed, an appropriate geometry of the left and right cam noses 8*c*, 8*c'*, left and right swing cam faces 9*b*, 9*b'*, and left and right intermediate rockers 10, 10' allow the intake valves 3, 3' to operate at different open and close timings as well as with different amounts of valve lift.

Figure 10:
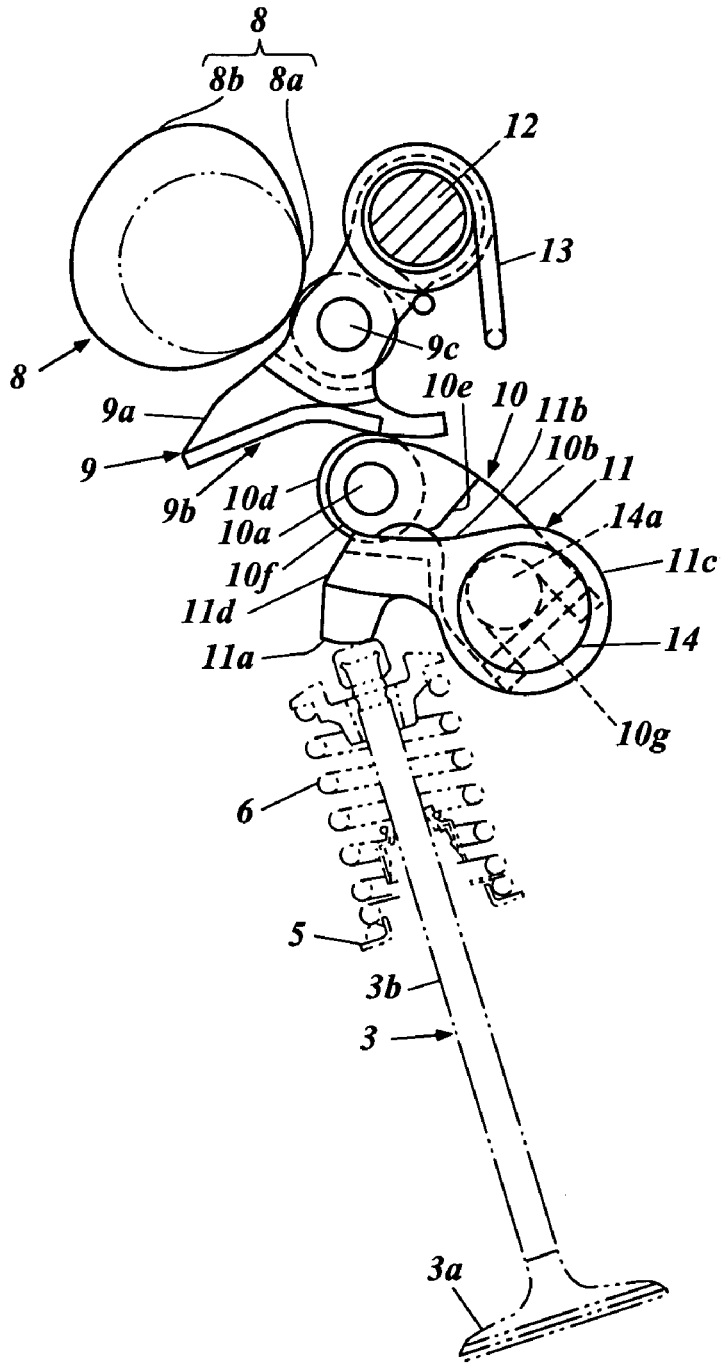

FIG. 10 is a drawing for description of a fourth embodiment according to the invention, in which the same reference numerals and symbols as those in FIGS. 8 and 9 represent the same parts or the equivalents. The fourth embodiment is an example in which a swing cam face 9*b* of a swinging member 9 presses against an intermediate rocker roller 10*d*. A pressing portion 10*e* is provided so as to project sideward from a side face of the distal end of a intermediate arm portion 10*b* and overlap the rocker arm 11. A pressing face 10*f* is formed in a lower surface of the distal end of the pressurized rocker face 11*b* of the rocker arm 11.

In this embodiment, the intermediate rocker 10 has an intermediate arm portion 10*b*, the base end of which is bifurcated and fitted in an eccentric pin portion 14*a*. An engagement pin 10*g* is passed through the bifurcated portion to shut the eccentric pin portion 14*a*. In such a way, the intermediate rocker 10 is rotationally coupled with a rocker shaft 14.

As described above, the rocker arm 11 is not pressed directly by the intermediate rocker pin 10*a*, but is pressed by the pressing face 10*f* that has a large curvature and is formed in the intermediate rocker 10. It is therefore possible to relax contact stress on the rocker pressing face and also to reduce the number of parts to be required.

In the embodiments described thusfar, it has been described that the swinging member 9 is supported by the swing shaft 12 and the rocker arm 11 is supported by the rocker shaft 14. However, in other embodiments, the swinging member 9 and the rocker arm 11 may be supported by a spherical pivot, respectively.

Also, it has been described that the drive device for swinging the swinging member 9 is a camshaft 8 or 18. However, the drive device is not limited to the camshaft. In other embodiments, any other type of driving devices, such as a solenoid type or a cylinder type that are capable of swinging the swinging member 9 in response to the engine speed may be used.

Further, in the embodiments described, the displacing device for the intermediate rocker 10 is of eccentric pin type that is incorporated in the rocker shaft 14. However, this displacing device is not limited to the eccentric pin type. Any other type of displacing device, such as a solenoid type or a cylinder type, may be used, which, in brief, are capable of displacing the intermediate rocker 10 so as to change the contact points between the rocker roller and rocker pin and the swing cam face and the pressurized rocker face.

Figure 11:
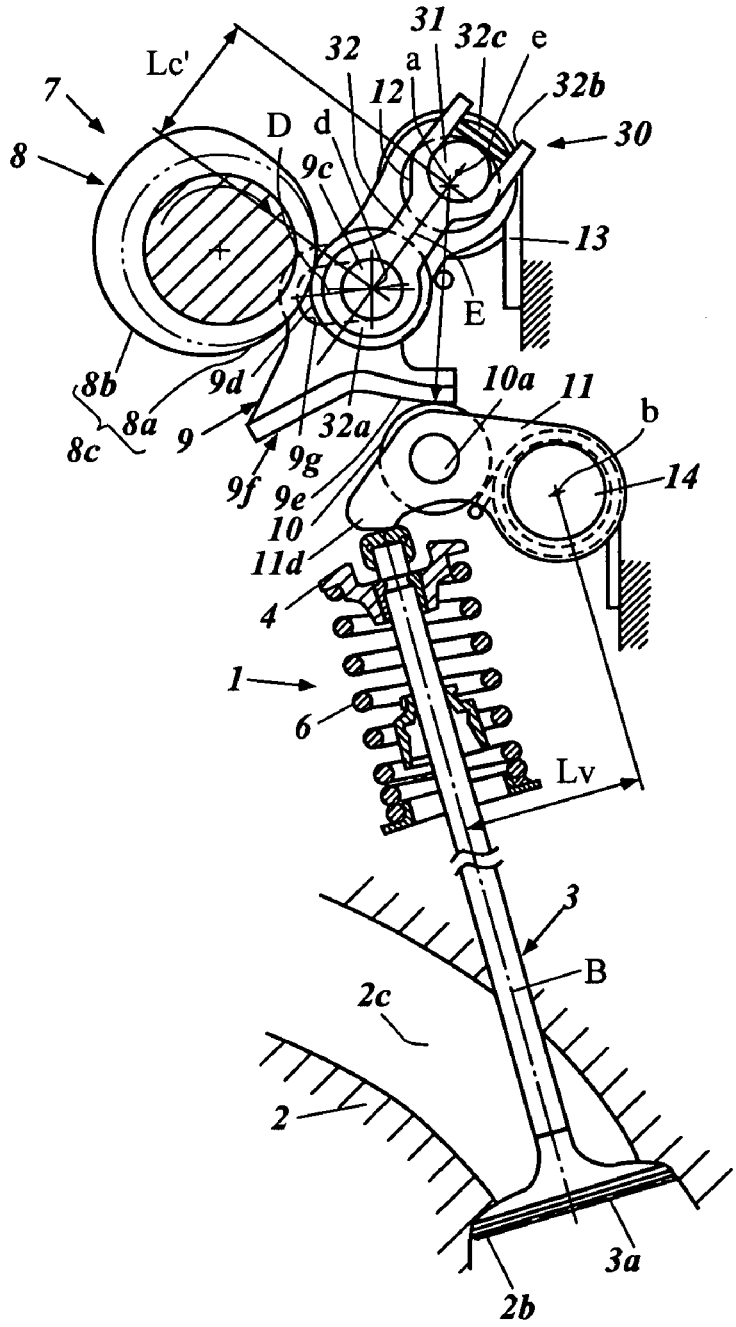
FIG. 11 is a cross-sectional side view of a fifth embodiment of the device
Figure 12:
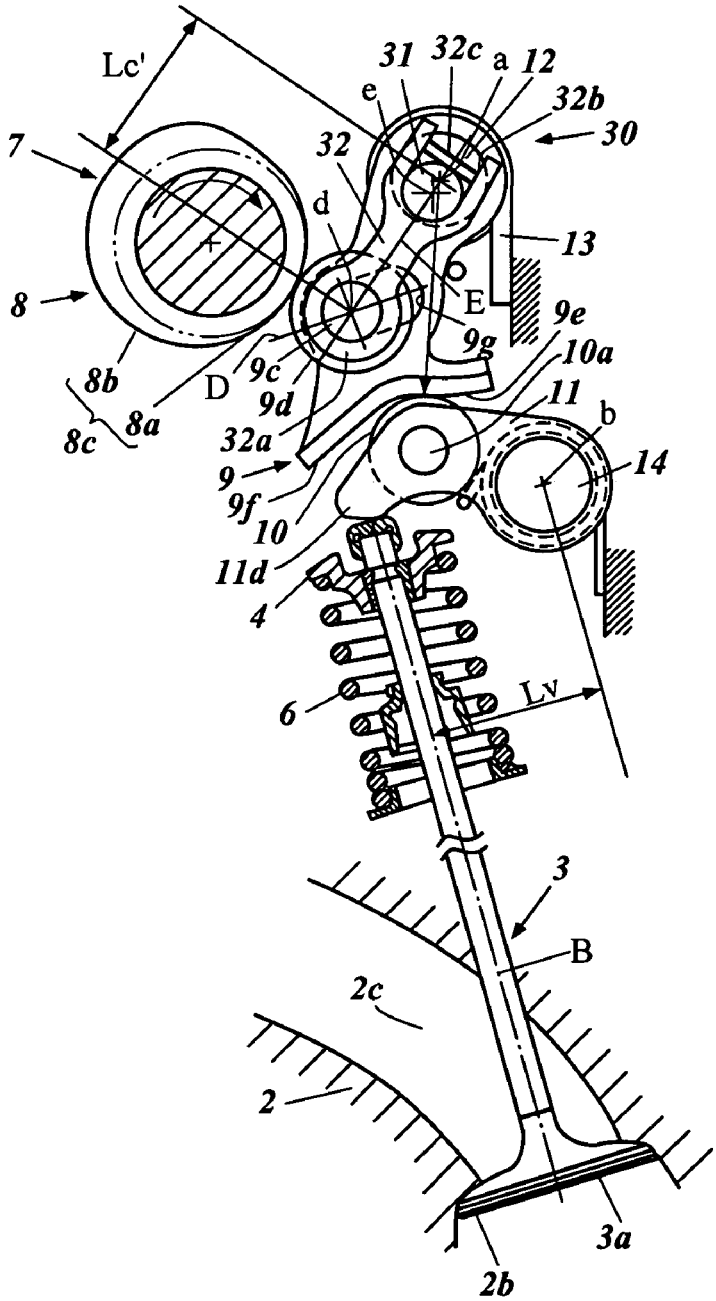
FIG. 12 is a cross-sectional side view of the device of a fifth embodiment according to the invention.

FIGS. 11 and 12 are drawings that depict a fifth embodiment according to the invention, in which the same reference numerals and symbols as those in FIGS. 1 to 10 represent the same parts or the equivalents.

The fifth embodiment is an example in which a roller 9*d* is attached to the swinging member 9 and rotationally contacts a cam nose 8*c* of a camshaft 8. A relative length Lc' between an axis (d) of a roller shaft 9*c* of a roller 9*d* and an axis (a) of a swing shaft 12 of the swinging member 9 is variable. The roller 9*d* is guided by changing the relative length in the direction D, which is inclined relative to a straight line (E) connecting the axis (a) with the axis (d).

Specifically, a lever ratio. Lv/Lc' of the swinging member when the valve opening duration is short is determined to be larger than that when the valve opening duration is long, where Lc' is defined as a relative distance between the axis (a) of the swing shaft 12 of the swinging member 9 and the axis (d) of a camshaft abutment portion (roller) 9*d* of the swinging member 9 which contacts with the cam nose 8*c*, and Lv is defined as a distance between an axis (b) of a swing shaft 14 of the rocker arm 11 and the valve axis (B).

Midway of the swinging member 9 is formed a guide 9*g* which is an elongated slot through the swinging member 9. A roller shaft 9*c* is passed through the guide 9*g* and is displaceable in the direction D. The roller shaft 9*c* has an axis (d) parallel to the swing shaft 12 and supports the roller 9*d* for rotation.

The guide 9*g* is formed in shape of an elongated slot for guiding the roller shaft 9*c* to a predetermined distance in the longitudinal direction of the guide 9*g*. The guide direction (the axis of the guide) (D) is defined to be inclined relative to the straight line (E) which connects the axis (a) of the swinging member 9 and the axis (d) of the roller 9*d*. More specifically, the guide 9*g* is guided in a way that the larger the relative length Lc' becomes (the more close to the state shown in FIG. 12), the more the guide 9*g* advances on the camshaft 8 side, and, on the contrary, the smaller the relative length Lc' becomes (the more close to the state shown in FIG. 11) the more the guide 9*g* retracts on the opposite side of the camshaft 8.

The swinging member 9 is provided with a roller (abutment portion) variable mechanism 30 for varying the relative length Lc' of the roller 9*d*. The roller variable mechanism 30 includes a drive shaft 31 formed to have an axis (e) which is parallel to the axis (a) and positioned to be eccentric in a radial direction thereof and an arm 32 having one end 32*a* which is connected with the roller 9*c* and having the other end 32*b* which is coupled with a drive shaft 31 for rotation relative thereto. The other end 32*b* is formed to be bifurcated and provided with a pin 32*c* for preventing the drive shaft 31 from coming off.

Here, an actuator (not shown) for rotating the swing shaft 12 about the axis (a) is coupled with an outer, axial end of the swing shaft 12 and is connected to a control device for controlling an angular position of the swing shaft 12, in response to the engine speed or engine load.

In the range of an idling operation or low-speed, low-load operation, as shown in FIG. 11, the actuator rotates the swing shaft 12 of the swinging member 9 to an angular position so that the axis (e) of the drive shaft 31 is positioned across the axis (a) of the swing shaft 12 from the roller 9*c*. At this time, the roller 9*d* is brought into a right end position of the guide 9*g*, which is the farthest position from the camshaft 8, resulting in the shortest relative length Lc' and the largest lever ratio (Lv/Lc') of the swinging member. At this time, the roller 9*d* is positioned on the opposite side of the camshaft 8. The swinging member 9 therefore contacts the rocker roller 10 at a right end (as shown in the drawing) of a base circle section 9*e* of the swing cam face of the swing ember 9, resulting in the shortest opening duration and the smallest lift of the valve 3.

As the engine speed and load become higher, as shown in FIG. 12, the actuator rotates the swing shaft 12 of the swinging member 9 to an angular position so that the axis (e) of the drive shaft 31 is positioned on the roller 9*c* side.

At this time, the roller 9*d* is brought into a left end position of the guide 9*g*, which is the nearest position from the camshaft 8, resulting in the longest relative length Lc' and the smallest lever ratio (Lv/Lc') of the swinging member. At this time, the roller 9*d* is positioned on the camshaft 8 side. The swinging member 9 therefore contacts the rocker roller 10 at a left end (as shown in the drawing) of a base circle section 9*e* of the swing cam face of the swing ember 9, resulting in the longest opening duration and the largest lift of the valve 3.

Also, in this embodiment, since a lever ratio Lv/Lc' of the swinging member in the engine operation range of a short valve opening duration is determined to be larger than that in the engine operation range of a long opening duration, the same effects as described in FIG. 5 are achieved. In other words, at the same valve opening, the valve lift drop is smaller than that in case of a constant lever ratio of the swinging member.

Further, since the roller variable mechanism 30 is constituted such that rotation of the swing shaft 12 of the swinging member 9 displaces the position of the drive shaft 31 and thus the position of the roller 9*d*, the relative distance between the roller 9*d* as a camshaft abutment portion and the swinging shaft 12 can be changed with a simple constitution.

Furthermore, since the longitudinal axis (D) of the elongated slot like guide 9*g* for guiding the roller 9*d* to the predetermined position is inclined relative to the straight line (E) of the swinging member 9, varying the relative distance Lc' between the roller 9*d* and the swing shaft 12 also varies the valve lift and the valve opening duration. Appropriate settings of the inclination angle and inclination direction of the longitudinal axis (D) allow for optional selection of the valve lift and valve opening duration.

Since the abutment portion to the camshaft 8 is a roller 9*d* that contacts and rotates on the cam nose 8*c* of the camshaft 8, it is possible to reduce the loss of the driving force transmitted from the camshaft 8 to the camshaft abutment.

Figure 13:
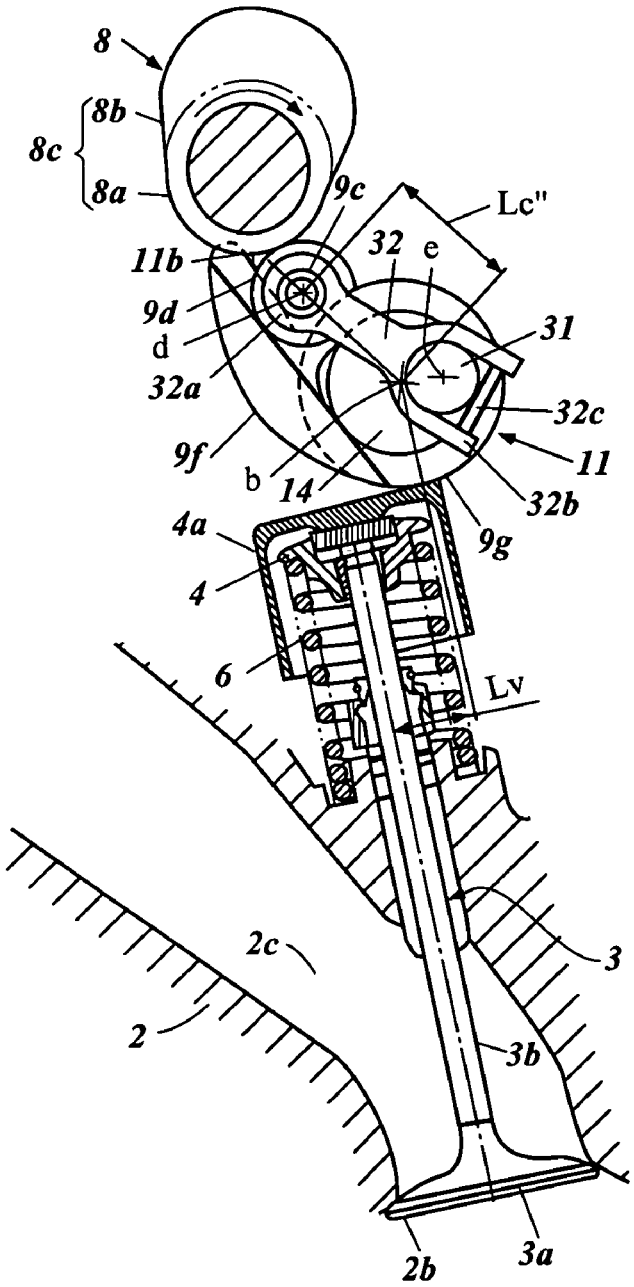
FIG. 13 is a cross-sectional side view of a sixth embodiment of the device in a first position.
Figure 14:
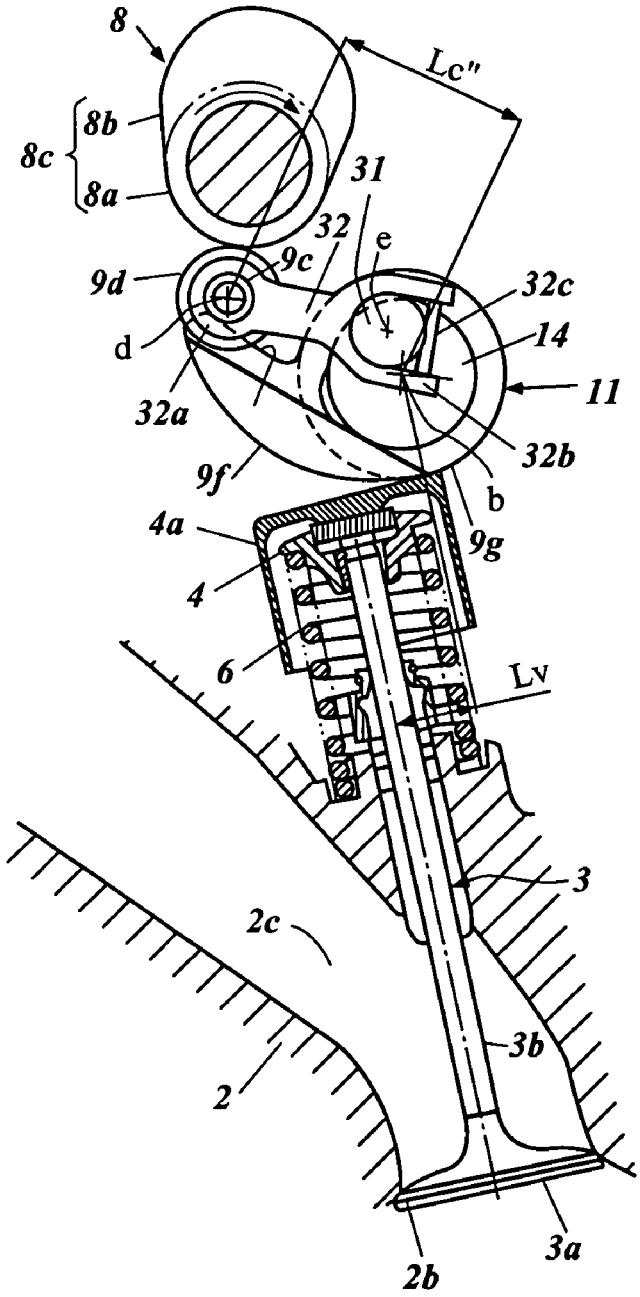
FIG. 14 is a cross-sectional side view of a sixth embodiment of the device in a second position.

FIGS. 13 and 14 are drawings for description of a sixth embodiment according to the invention, in which the same reference numerals and symbols as those in FIGS. 11 and 12 represent the same parts or the equivalents.

In the sixth embodiment, a rocker arm 11 serves as the swinging member in each embodiment described above, and an relative distance Lc" between the rotation axis (d) of the roller 9*d* driven by the camshaft 8 and the swinging axis (b) of the rocker arm 11 is variable.

Specifically, the rocker arm 11 is supported by a swing shaft 14 and swung about a swinging axis (b). The rocker arm 11 is biased by a biasing spring (not shown) in clockwise direction as shown in the drawing, to thereby normally press a rocker pressing face against the roller shaft 9*c*, and press the roller 9*d* against a cam nose 8*c* of the camshaft 8. The rocker arm 11 is formed with a cam face consisting of a base circle section 9*g* which is a concentric circle whose center is the swinging center (b) and does not lift the valve 3 with increase of the swinging angle, and a lift section 9*f* for lifting the valve 3 with increase of the swinging angle of the rocker arm 11 in counterclockwise, as shown in the drawing. The cam face presses and drives the valve 3 via a valve lifter 4*a* that is disposed at the top end of the valve 3.

The rocker arm 11 is provided with a roller variable mechanism 30 for varying the relative distance Lc". This roller variable mechanism 30 includes a drive shaft 31 that is formed at a position radially eccentric from the axis (b) of the swing shaft 14 and has an axis (e) parallel to the axis (b), and an arm 32 having one end 32*a* coupled with the roller shaft 9*c* and the other end 32*b* coupled with the drive shaft 31 for rotation relative thereto. The other end 32*b* is formed to be bifurcated and provided with a pin 32*c* for preventing the drive shaft 31 from coming off.

Here, an actuator (not shown) for rotating the swing shaft 14 about the axis (b) is coupled with an outer, axial end of the swing shaft 14 and is connected to a control device for controlling an angular position of the swing shaft 14, in response to the engine speed or engine load.

Now, a rocker lever ratio Lv/Lc" when the valve opening duration is short, where Lc" is a relative distance between the axis (b) of the swing shaft 14 of the rocker arm 11 and the axis (d) of the roller 9*d*, and when Lv is a distance between the axis (b) of the swing shaft 14 of the rocker arm 11 and the valve axis (B), is determined to be larger than that when the valve opening duration is large.

In the range of an idling operation or low-speed and low-load operation, as shown in FIG. 13, the actuator rotates the swing shaft 14 to an angular position so that the axis (e) of the drive shaft 31 is positioned across the axis (b) of the swing shaft 14 from the roller 9*c*. At this time, the roller 9*d* is brought to the farthest position from the camshaft 8, resulting in the shortest relative length Lc" and the largest rocker lever ratio (Lv/Lc"). At this time, for the rocker arm 11 at start of an intake stroke, the base circle section 9*e* of the cam face contacts the valve lifter 4*a* at a portion of the base circle section 9*e* remote from the lift section 9*f*. In a predetermined time duration at each of an initial and end stages of the intake stroke, the base circle section 9*e* contacts the valve lifter 4*a* and the valve 3 is not lifted, resulting in the shortest opening duration and the smallest valve lift of the valve 3.

As the engine speed and load become higher, as shown in FIG. 14, the actuator rotates the swing shaft 14 so that the axis (e) of the drive shaft 31 is positioned on the roller 9*d* side, resulting in the longest relative length Lc" and the smallest rocker lever ratio (Lv/Lc"). At this time, the rocker arm 11 contacts the valve lifter 4*a* nearly at the boundary between the base circle section 9*g* and the lift section 9*f* of the cam face. The lift section 9*f* contacts the valve lifter 4*a* immediately at the initial and end stages of the intake stroke, resulting in the longest opening duration and the largest lift of the valve 3.

By the way, during the intake stroke, the contact point of between the cam face of the rocker arm 11 and the valve lifter 4*a* is changed in its position such that the contact point is displaced from one side to the other side and subsequently returns from the other side to the one side of the valve axis (B). Accordingly, in this embodiment, the lever length (Lv) is defined as a distance between the valve axis (B) and the axis (b) of the rocker arm 11.

Thus, in this embodiment, since the rocker lever ratio Lv/Lc" in the engine operation range of a short valve opening duration is determined to be larger than that in the engine operation range of a long opening duration, the same effects as described in FIG. 5 are achieved. In other words, at the same opening of the valve, the valve lift drop is smaller than that in case of a constant rocker lever ratio.

Further, since the roller variable mechanism 30 is constituted such that rotation of the swing shaft 14 of the rocker arm 11 displaces the position of the drive shaft 31 and thus the position of the roller 9*d*, the relative distance Lc" can be changed with a simple constitution.

Since the camshaft abutment portion on the camshaft 8 is a roller 9*d* that contacts and rotates on the cam nose 8*c* of the camshaft 8, it is possible to reduce the loss of the driving force transmitted from the camshaft 8 to the camshaft abutment portion.

According to the embodiments described above it is more efficient to secure the valve lift since the lever ratio is determined to be larger when the valve opening duration is shorter. It is therefore possible to reduce pumping loss, improve combustibility, suppress reduction of the ramp velocity, and improve the ability to control the valve opening and closing timing.

According to another embodiment, when the swing shaft is swung by the driving device, the rocker arm is swung by the swing of the swing shaft via the intermediate rocker member to open and close the valve. The opening duration and the lift of the valve can be adjusted continuously, since the contact point between the pressurized rocker face and the swing cam face of the intermediate rocker member is forced to displace.

Additionally, according to another embodiment, an action to increase the valve lift in spite of a shorter opening duration of the valve, is achieved since the rocker lever ratio (Lv/Lc) is determined to be larger for a shorter opening duration of the valve. Also, as described above, the swinging member lever ratio (Lv/Lc') is determined to be larger for a shorter opening duration of the valve, and the rocker lever ratio (Lv/Lc") is determined to be larger for a shorter opening duration of the valve. It is therefore possible to reduce pumping loss, suppress reduction in the ramp velocity, and improve combustibility and ability to control the valve opening and closing timing.

Also, according to another embodiment, the contact point between the pressurized rocker face and the intermediate rocker member is positioned approximately just above the valve axis since the rocker lever ratio is determined to be smaller for a longer opening duration of the valve. It is also possible to increase the rigidity as a whole of the valve opening and closing mechanism.

According to another embodiment, the intermediate rocker roller and the intermediate rocker pin are provided at the distal end of the intermediate arm portion; the camshaft is located across the swinging member from the rocker shaft of the rocker arm; the swinging member is located such that the base circle section of the swing cam face is located on the rocker shaft side; and the rocker lever ratio becomes larger as the intermediate rocker roller and the intermediate rocker pin are moved toward the rocker shaft side, and, in contrast, it becomes smaller as they are moved away from the rocker shaft side. The locker lever ratio (Lv/Lc) for a shorter opening duration of the valve can be determined to be larger than that for a longer opening duration of the valve.

Further, according to another embodiment, the intermediate rocker roller and the intermediate rocker pin can be displaced toward or away from the rocker shaft side, using a simple configuration, to continuously control the valve opening duration and the valve lift, since a connection recess formed in the base end of the intermediate rocker member is engaged with the eccentric pin provided midway of the rocker shaft to rotate the rocker shaft.

According to another embodiment 5, since the camshaft may be of crankshaft type having a cam plate, and the cam plate and the swinging member are connected via the connecting rod, the swinging member can be securely and easily driven with sufficient ability to follow and oscillate easily, resulting in improvement of accuracy to control the valve opening duration and the valve lift.

According to another embodiment, the relative distance between the camshaft abutment portion and the swinging axis can be changed with a simple constitution of the abutment displacing mechanism which includes a drive shaft having its axis displaceable relative to the swinging axis of the swinging member or the rocker member, and an arm portion having one end coupled with the camshaft abutment portion and the other end coupled with the drive shaft.

According to another embodiment, a guide portion for guiding the camshaft abutment portion to a given position is inclined relative to the radial direction of the camshaft. The range of the combination of the valve lift and the valve opening duration can be therefore extended due to the variable relative distance between the camshaft abutment portion and the swinging shaft.

According to another embodiment, since the camshaft abutment portion is a roller that contacts and rotates on the camshaft, it is possible to reduce loss of the driving force transmitted from the camshaft to the camshaft abutment portion.

Although the foregoing systems and methods have been described in terms of certain preferred embodiments, other embodiments will be apparent to those of ordinary skill in the art from the disclosure herein. Additionally, other combinations, omissions, substitutions and modifications will be apparent to the skilled artisan in view of the disclosure herein. While certain embodiments of the inventions have been described, these embodiments have been presented by way of example only, and are not intended to limit the scope of the inventions. Indeed, the novel methods and systems described herein may be embodied in a variety of other forms without departing from the spirit thereof.

What is claimed is:

1. A valve train device of an engine for swinging a rocker arm, which is pivotally disposed on a rocker arm support shaft, to drive a valve for opening and closing a valve opening in a combustion chamber, the device comprising a drive device for driving the rocker arm, an intermediate member disposed between the drive device and the rocker arm, the intermediate member configured to transfer a driving force of the drive device to the rocker arm, and a displacement device configured to displace a contact point between the rocker arm and the intermediate member to continuously adjust at least one of the valve opening duration and valve lift, the displacement device including a moveable portion that is coupled to an arm, a portion of the arm moving about a first axis, wherein the displacement device is configured such that at least one of the valve opening duration and valve lift is increased as the moveable portion is displaced farther from the first axis.

2. The valve train device according to claim 1, comprising a swing member pivotally supported on a swing member support shaft, the swing member being disposed between the intermediate member and the drive device and configured to transmit motion of the drive device to the intermediate member.

3. The valve train device according to claim 2, wherein the intermediate member is pivotally supported on the rocker arm support shaft, wherein a rocker lever ratio Lv/Lc is defined such that Lv is defined as a distance between a pivot axis of the rocker arm and an axis of the valve, and Lc is defined as a distance between the pivot axis of the rocker arm and a line which connects a pivot axis of the swinging member to a contact point between the intermediate member and the swing member, and wherein, as the moveable portion is displaced farther from the first axis, the rocker lever ratio Lv/Lc decreases for a longer opening duration of the valve.

4. The valve train device according to claim 3, wherein the displacement device comprises an intermediate rocker roller that is disposed about an intermediate rocker pin at a distal end of an intermediate arm portion of the intermediate member, the contact point between the intermediate member and the swing member being formed at least in part on the intermediate rocker roller.

5. The valve train device according to claim 4, wherein the drive device is a camshaft that is located across from the rocker arm support shaft.

6. The valve train device according to claim 5, wherein the contact point between the swing member and the intermediate member is formed at least in part on a swing cam face having a base circle section that does not allow the valve lift to change with change of a swinging angle of the swing member and a lift section that continuously connects with the base circle section and allows the valve lift to increase with an increase of the swinging angle of the swing member, the swing member being located such that the base circle section and the rocker arm support shaft are located on a same side of the valve.

7. The valve train device of an engine according to claim 6, wherein the displacement device comprises an eccentric pin portion that is formed on the rocker arm support shaft; a base end of an intermediate arm portion of the intermediate member being pivotally connected to the eccentric pin portion; and wherein rotation of the rocker arm support shaft allows the contact point between the intermediate member and the swing member to be displaced with respect to the rocker arm support shaft.

8. The valve train device according to claim 5, wherein the camshaft is of crankshaft-type comprising a cam plate and a connecting rod coupled to the cam plate; a base end of the connecting rod being pivotally coupled with the cam plate; and the distal end of the connecting rod being pivotally coupled to the swing member.

9. The valve train device according to claim 2, wherein drive device is a camshaft and the displacement device comprises a camshaft abutment portion that is positioned on the swing member and an abutment displacement mechanism, the abutment displacement mechanism configured to change a relative distance between the swing member support shaft and the camshaft abutment portion to permit continuous adjustment of at least one of the opening duration and the lift of the valve.

10. The valve train device according to claim 9, wherein a swing member lever ratio Lv/Lc' is defined where Lc' is a relative distance between the camshaft abutment portion and a swing axis of the swing member and Lv is the distance between a swing axis of the rocker arm and an axis of the valve, the ratio Lv/Lc' decreasing for a longer opening duration of the valve.

11. The valve train device to claim 9, wherein the abutment displacement mechanism includes a drive shaft having its axis displaceable relative to the first axis which is the swing axis of the swinging member, and the arm portion having one end coupled with the camshaft abutment portion and having an opposite end coupled with the drive shaft; the displacing mechanism being configured such that displacement of the drive shaft displaces the camshaft abutment portion via the arm portion to change the relative distance between the camshaft abutment portion and the swing axis of the swing member.

12. The valve train device according to claim 11, wherein the axis of the drive shaft is located eccentrically relative to the swing axis of the swing member; and the rotation of the swing member support shaft by a given angle displaces the camshaft abutment portion via the arm to change the relative distance between the camshaft abutment portion and the swing axis of the swing member.

13. The valve train device according to claim 12, wherein the swing member has a guide portion for guiding the camshaft abutment portion to a given position; and the rotation of the swing member support shaft by a given angle causes the position of the camshaft abutment portion to displace along the guide portion, and wherein a guiding direction of the guide portion is inclined relative to the radial direction of the camshaft.

14. The valve train device according to claim 13, wherein the camshaft abutment portion is a roller that is supported by a roller shaft which is generally parallel to the swing member support shaft of the swing member, the roller contacting the camshaft for rotation.

15. The valve train device according to claim 1, wherein the driving device is a camshaft that is rotated by a crankshaft; the intermediate member includes a camshaft abutment portion for transmitting drive force from the camshaft to the rocker arm, wherein the displacement device is configured to change the relative distance between the camshaft abutment portion and a swing axis of the rocker arm to continuously change at least one the opening duration and the lift of the valve.

16. The valve train device of claim 15, wherein a rocker lever ratio Lv/Lc" is defined where Lc" is a relative distance between the camshaft abutment portion and the swing axis of the rocker arm, and Lv is a distance between a swing axis of the rocker arm and an axis of the valve, the ratio Lv/Lc" decreasing for a longer opening duration of the valve.

17. The valve train device according to claim 16, wherein the abutment displacement mechanism includes a drive shaft that has an axis and is configured such that the axis of the drive shaft is displaceable relative to the swing axis of the rocker arm, the abutment displacement mechanism comprising and an arm portion having one end coupled with the camshaft abutment portion and the other end coupled with the drive shaft.

18. The valve train device according to claim 17, wherein the axis of the drive shaft is located eccentrically relative to the swing axis of the rocker arm; and the rotation of the rocker arm support shaft by a given angle displaces the camshaft abutment portion via the arm.

19. The valve train device of claim 18, wherein the camshaft abutment portion is a roller that is supported by a roller shaft that is generally parallel to the swing axis of the rocker arm, the roller contacting the camshaft for rotation.

20. A valve train device of an engine for swinging a rocker arm, which is pivotally disposed on a rocker arm support shaft, to drive a valve for opening and closing a valve opening in a combustion chamber, the device comprising a drive device for driving the rocker arm, an intermediate member pivotally supported on an intermediate member support shaft and disposed between the drive device and the rocker arm, the intermediate member configured to transfer movement of the drive device to the rocker arm, a displacement device that includes a moveable portion configured to displace a contact point between the rocker arm and the intermediate member to continuously adjust at least one of the valve opening duration and valve lift, and means for increasing at least one of the valve opening duration and valve lift as the moveable portion is displaced farther from the intermediate arm support shaft.

* * * * *